US006497006B2

(12) United States Patent
Gallup

(10) Patent No.: US 6,497,006 B2
(45) **Date of Patent: *Dec. 24, 2002**

(54) REMOVABLE GRIP FOR A BUCKET

(76) Inventor: Eric M. Gallup, 461 Shortridge Dr., Rochester Hills, MI (US) 48307

( * ) Notice: Subject to any disclaimer, the term of this patent is extended or adjusted under 35 U.S.C. 154(b) by 0 days.

This patent is subject to a terminal disclaimer.

(21) Appl. No.: 09/927,689

(22) Filed: Aug. 10, 2001

(65) Prior Publication Data

US 2002/0020040 A1 Feb. 21, 2002

Related U.S. Application Data

(63) Continuation-in-part of application No. 09/636,372, filed on Aug. 11, 2000, now Pat. No. 6,336,255.

(51) Int. Cl.[7] ..... A45C 13/22; A45F 5/10

(52) U.S. Cl. ..... 16/425; 16/411; 16/DIG. 12; 16/110.1; 16/903

(58) Field of Search ..... 16/425, 422, 428, 16/411, DIG. 12; 229/117.9, 117.19; 383/6, 13; 220/755, 759, 760; 294/171, 170; D7/393–395; D8/107, 300, 303

(56) References Cited

U.S. PATENT DOCUMENTS

| | | | | | |
|---|---|---|---|---|---|
| 96,889 | A | | 11/1869 | Covell | |
| 614,173 | A | | 11/1898 | Kelly | |
| 1,226,403 | A | | 5/1917 | Snyder | |
| 1,235,309 | A | | 7/1917 | Garretson | |
| 1,678,005 | A | | 7/1928 | Hallerman | |
| 2,287,329 | A | | 6/1942 | Santa Maria et al. | |
| 2,294,197 | A | | 8/1942 | Moore et al. | |
| 2,589,423 | A | | 3/1952 | Nadolsky et al. | |
| 2,684,797 | A | * | 7/1954 | Schulte | 16/406 |
| 2,743,046 | A | | 4/1956 | Williams | |
| 2,846,714 | A | | 8/1958 | Charlick | |
| 3,486,684 | A | * | 12/1969 | Dills | 16/411 |
| 3,635,382 | A | * | 1/1972 | Wilson | 16/411 |
| 3,912,140 | A | * | 10/1975 | Franges | 16/411 |
| 4,590,640 | A | * | 5/1986 | Enersen | 16/411 |
| 4,656,566 | A | | 4/1987 | Kelley | |
| 4,823,433 | A | | 4/1989 | Curtis | |
| 4,932,702 | A | | 6/1990 | Sweeney | |
| 4,955,609 | A | | 9/1990 | Kassen | |
| 4,982,989 | A | | 1/1991 | Sweeny | |
| 5,411,307 | A | * | 5/1995 | Roberts | 294/171 |
| D362,181 | S | | 9/1995 | Meyers et al. | |
| 5,509,708 | A | | 4/1996 | Nathan | |
| D369,549 | S | | 5/1996 | Meyers et al. | |
| 5,519,908 | A | | 5/1996 | Steinman et al. | |
| 5,738,401 | A | | 4/1998 | Fan | |
| 5,778,489 | A | | 7/1998 | Marshal, II | |
| 5,797,166 | A | | 8/1998 | Wagenheim | |

FOREIGN PATENT DOCUMENTS

| | | |
|---|---|---|
| GB | 2116835 A | 10/1983 |
| IT | 293172 | 2/1932 |

* cited by examiner

*Primary Examiner*—Chuck Y. Mah
(74) *Attorney, Agent, or Firm*—John A. Miller; Warn, Burgess & Hoffman, P.C.

(57) ABSTRACT

A removable grip for a five-gallon bucket that includes a prying tool for removing a lid of the bucket. The grip includes an elongated body in which a channel is formed. The channel includes a centrally disposed widened portion that is configured to accept an existing grip formed on a bail of the bucket handle. The channel also includes narrow portions at each end of the widened portion that accept the bail. Flexible tabs within each narrow portion lock the grip onto the bail. The prying tool includes a flat end and a hooked end. The flat end can be used to pry open the lid of a paint bucket and can be a screwdriver end. The hooked end can be used to pry up the tangs of the lid of the five-gallon bucket to remove the lid.

22 Claims, 6 Drawing Sheets

REMOVABLE GRIP FOR A BUCKET

CROSS-REFERENCE TO RELATED APPLICATIONS

This application is a continuation-in-part of United States patent application Ser No. 09/636,372, filed on Aug. 11, 2000, entitled Removable Grip for a Bucket now U.S. Pat. No. 6,336,255.

BACKGROUND OF THE INVENTION

1. Field of the Invention

This invention relates generally to a removable grip for carrying a bucket and, more particularly, to a removable grip for carrying a five-gallon bucket, that includes a hook tool for removing the lid of the five-gallon bucket and a pry tool for removing the lid of a paint can.

2. Discussion of the Related Art

Five-gallon buckets are commonly used in various trades for carrying and storing many things, such as various solvents, chemicals, paints, and the like. The size of the five-gallon bucket provides a convenient way of holding a large quantity of such products for larger jobs without being overly burdensome. However, the weight of such products makes these buckets somewhat difficult to manage, especially when they are full. The buckets are typically molded plastic and are equipped with a wire bail for carrying the bucket. Because of the weight of the bucket, the bail may dig into the user's hand when he is carrying the bucket. A small plastic grip is sometimes provided on the wire bail to lessen the stress on the user's hand, but these grips are typically not enough to significantly alleviate the discomfort of carry the buckets because they are not wide enough and do not adequately conform to the hand of the user.

Various grips are known in the art for carrying buckets to reduce the stress on the user's hand. For example, U.S. Pat. No. 4,823,433 issued to Curtis discloses a paint bucket handle accessory including an elongated grip having a slot that accepts a wire bail of the paint bucket. Various other designs of this type are also known in the art.

Plastic five-gallon buckets typically include a lid that is secured to the bucket by a series of tangs that conform to the upper edge of the bucket. Various tools can be used for removing the lid of these buckets, such as a screwdriver. Other types of buckets, such as paint cans and metal five-gallon buckets, have other types of lids that also require use of a similar prying tool to be removed.

SUMMARY OF THE INVENTION

In accordance with the teachings of the present invention, a removable grip for a five-gallon bucket is disclosed that includes a prying tool for removing the lid of the bucket. The grip includes an elongated body in which a channel is formed. The channel includes a centrally disposed widened portion that is configured to accept an existing grip formed on a bail of the bucket handle. The channel also includes a narrow portion at each end of the widened portion that accepts the bail. Flexible tabs within each narrow portion lock the grip onto the bail. In one embodiment, the prying tool includes a flat or screwdriver end extending from one end of the body and a hooked end extending from an opposite end of the body. The flat end can be used to pry open the lid of a paint bucket, and the hooked end can be used to pry up the tangs of the lid of the five-gallon bucket to remove the lid.

Additional objects, features and advantages of the present invention will become apparent from the following description and appended claims taken in conjunction with the accompanying drawings.

DETAILED DESCRIPTION OF THE EMBODIMENTS

The following discussion of the embodiments of the invention directed to a removable grip for a five-gallon bucket that includes a prying tool for removing the bucket lid is merely exemplary in nature and is in no way intended to limit the invention or its applications or uses. For example, the grip of the invention discussed herein is for a five-gallon bucket. However, the grip can be configured for other types of buckets.

Figure 1:
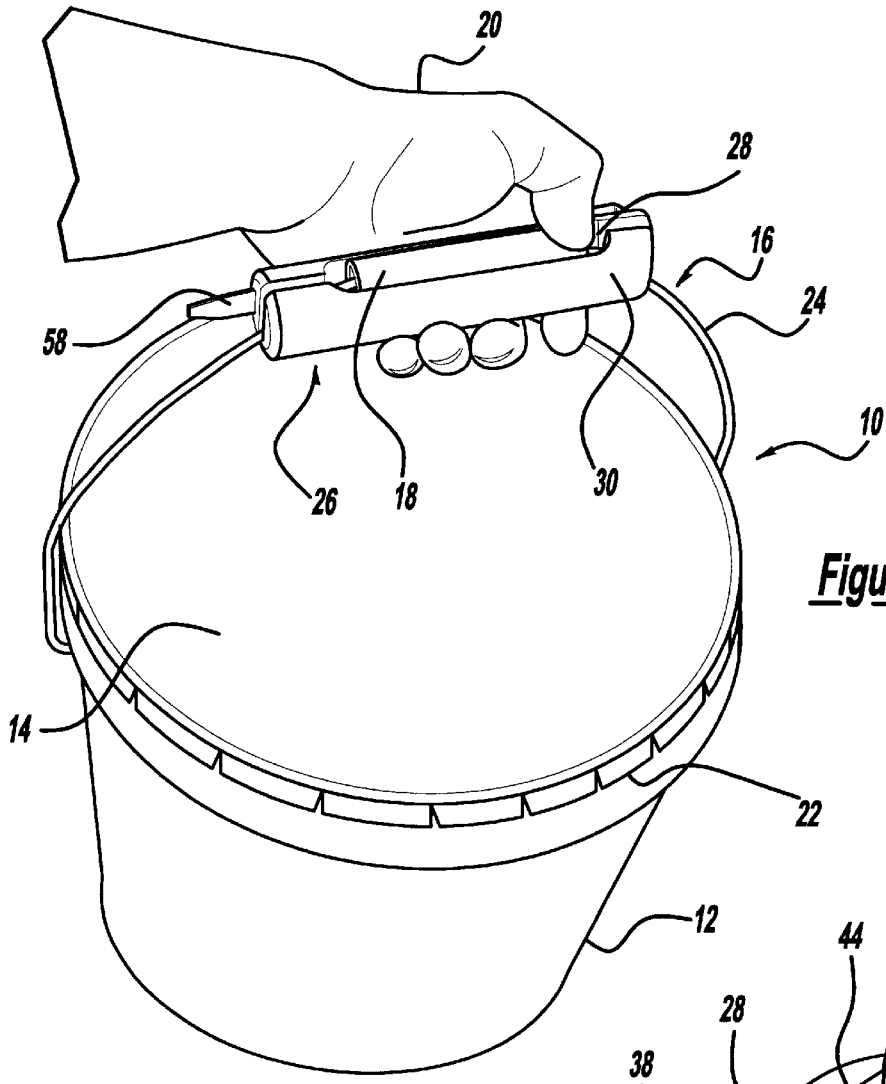
FIG. 1 is a perspective view of a five-gallon bucket being carried by a user, where the user is using a removable grip, according to an embodiment of the present invention.
Figure 2:
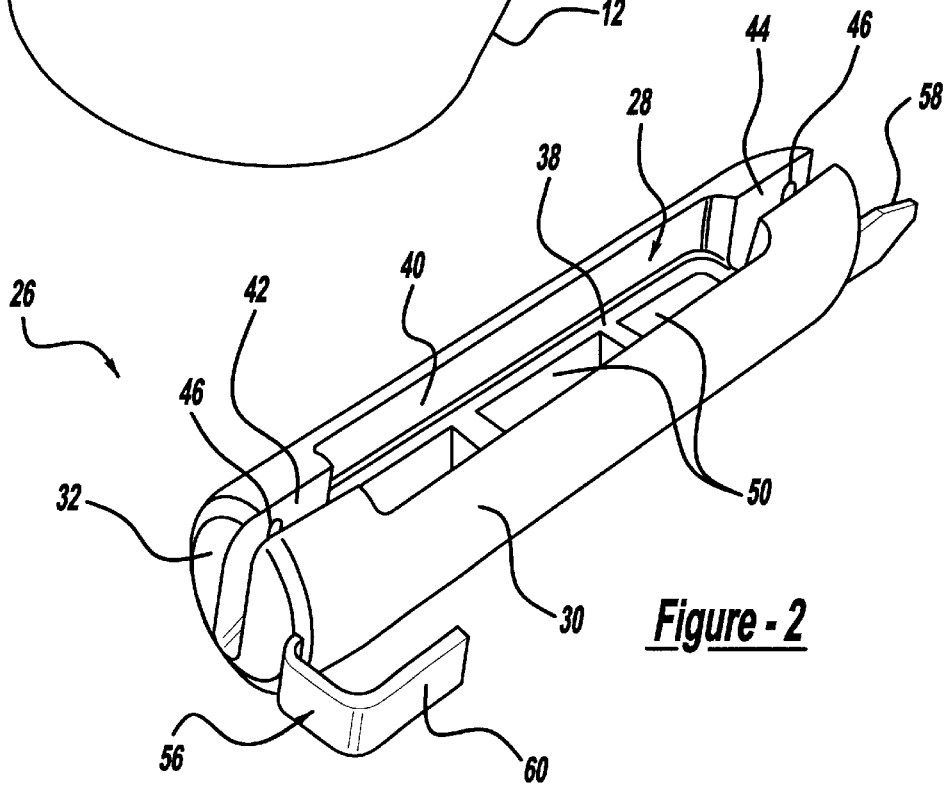
FIG. 2 is a perspective view of the grip shown in FIG. 1 removed from the bucket, according to one embodiment of the present invention.
Figure 3:
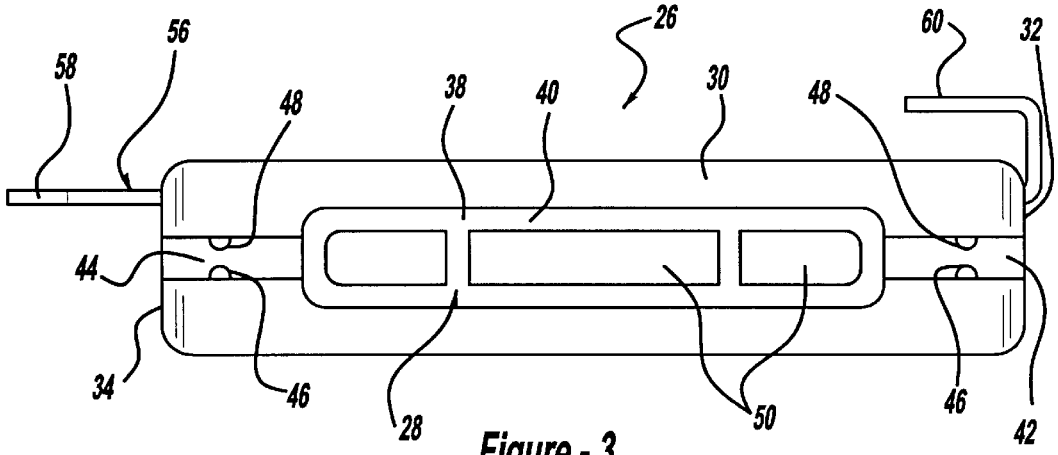
FIG. 3 is a top view of the removable grip of the invention shown in FIG. 2.
Figure 4:
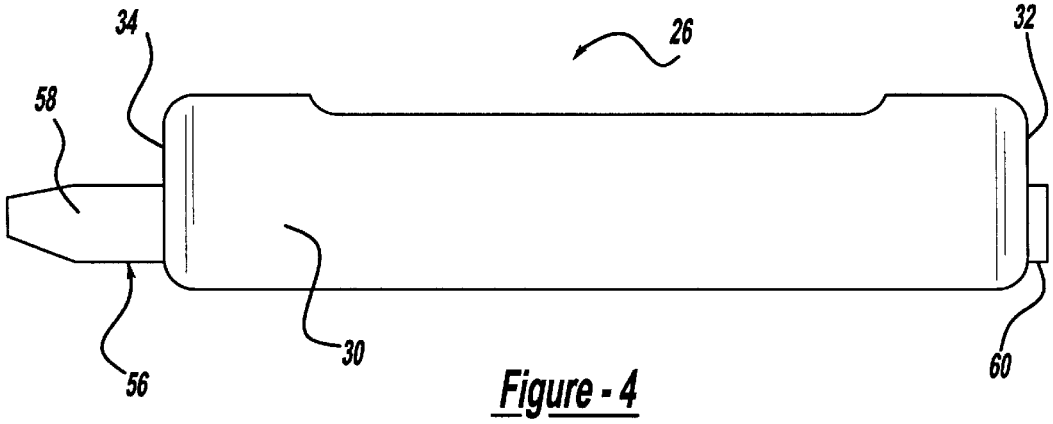
FIG. 4 is a side view of the removable grip of the invention shown in FIG. 2.
Figure 5:
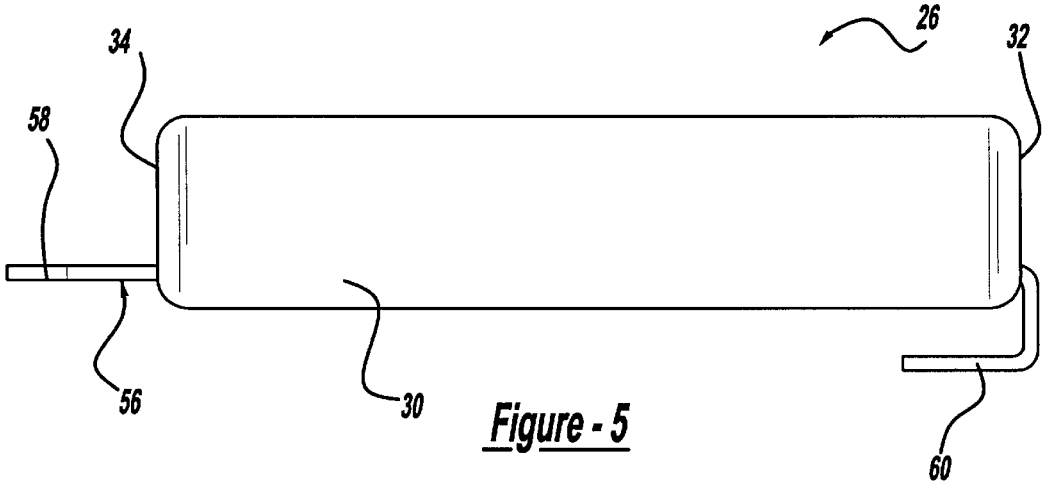
FIG. 5 is a bottom view of the removable grip of the invention shown in FIG. 2.
Figure 6:
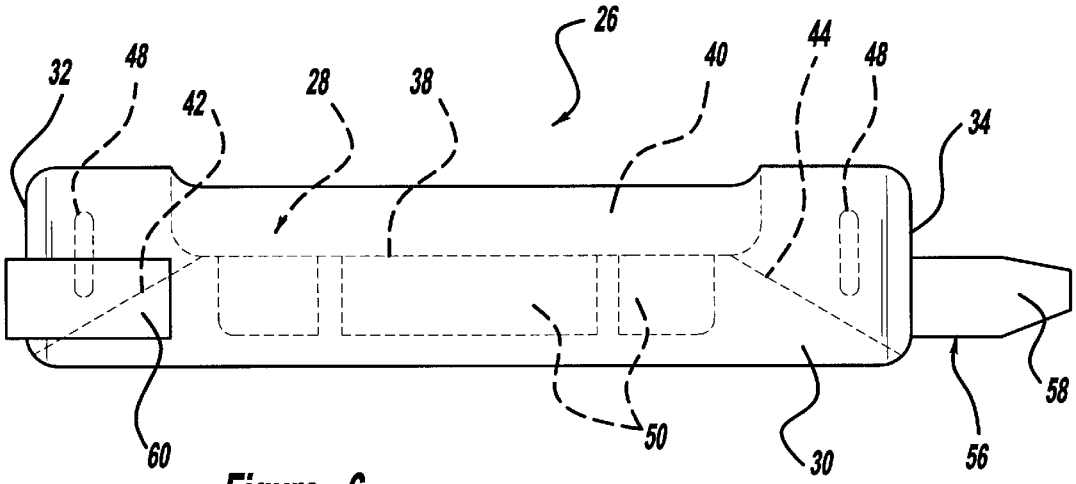
FIG. 6 is another side view of the removable grip of the invention shown in FIG. 2.
Figure 7:
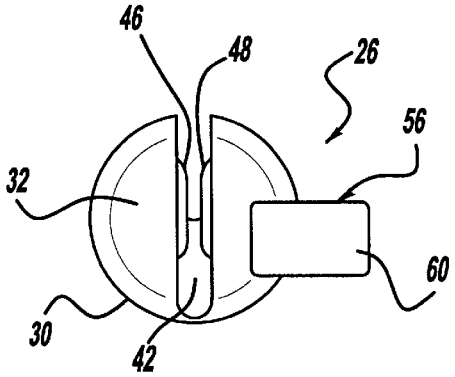
FIG. 7 is an end view of the removable grip of the invention shown in FIG. 2.
Figure 8:
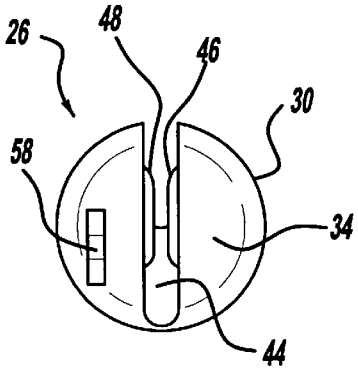
FIG. 8 is an opposite end view of the removable grip of the invention shown in FIG. 2.

FIG. 1 is a perspective view of a plastic five-gallon bucket 10 including a bucket portion 12, a lid 14 and a handle 16 including a wire bail 24. The bucket portion 12 is typically used to hold and store various paints, solvents or chemicals, as is well understood in the art. The lid 14 is secured to the bucket portion 12 by a plurality of spaced tabs 22. The handle 16 includes a plastic grip portion 18 formed on the bail 24 that is common in the industry for alleviating stress on a hand 20 of a user who may be carrying the bucket 10. However, the grip portion 18 is typically not sufficient enough for its intended purpose.

According to the invention, a removable grip 26 is described herein that includes a channel 28 that accepts the handle 16, as shown. FIGS. 2–8 show various views of the grip 26 removed from the bucket 10. The grip 26 is a molded plastic piece, in one embodiment, where the channel 28 is formed within an elongated cylindrical body 30 of the grip 26. The channel 28 extends from one end 32 of the body 30 to an opposite end 34 of the body 30 so that the handle 16 can extend out of the ends 32 and 34 of the grip 26. The channel 28 includes a rectangular-shaped widened portion 40 that is sized to accept the grip portion 18, and narrow portions 42 and 44 at the ends of the widened portion 40 that are sized to be too small for the grip portion 18, but can accept the bail 24. The widened portion 40 also includes a bottom surface 38 that is curved to conform to the grip portion 18. Cavities 50 are formed in the body 30 through the surface 38 to reduce the weight of the grip 26. Additionally, the body 30 can include indentations (not shown) in the outside of the body 30 that conform to the user's hand 20 to make the grip 26 more ergonomically beneficial.

The narrow portions 42 and 44 are angled and slant down from the surface 38 to conform to the shape of the bail 24. A pair of vertically extending opposing ridges 46 and 48 are formed on opposing walls within each of the narrow portions 42 and 44, and are spaced apart from each other a predetermined distance so that the diameter of the bail 24 can be forced between the ridges 46 and 48. The bail 24 is then locked below the ridges 46 and 48 so that the grip 26 stays on the handle 16. The user can then remove the grip 26 from the handle 16 by forcing the bail 24 back though the ridges 46 and 48. The ridges 46 and 48 are provided as one way of holding the grip 26 onto the handle 16. As will be appreciated by those skilled in the art, other structural elements can also be used to hold the grip 26 on the handle 16 within the scope of the present invention.

The grip 26 is molded from any suitable plastic, such as polyethylene, so that it is lightweight, durable, easy to clean and can be made of any color. The dimensions of the grip 26 are given herein by way of a non-limiting example in that other dimensions can be used within the scope of the invention. In one embodiment, the body 30 is about six inches long and is about 1.25 inches in diameter; the widened portion 40 is about 3.75 inches long, about 0.25–0.5 inches deep and about 0.5–0.75 inches wide; and the narrow portions 42 and 46 are about 1 inch long and about one-eighth inch wide.

According to the invention, the grip 26 includes a single piece prying tool 56 that is formed in the body 30 when it is molded. In one embodiment, the prying tool 56 is made of steel to be strong enough to pry open bucket lids, as will be discussed below. The prying tool 56 includes a flat, pointed end 58 extending from the end 34 of the body 30 and a square hooked end 60 extending from the end 32 of the body 30. The flat end 58 and the hooked end 60 of the prying tool 56 can be used in various ways to remove different types of bucket lids, including plastic five-gallon bucket lids, metal paint cans, metal five-gallon buckets, etc., as will be discussed in more detail below. The hooked end 60 can also be used to hang the grip 26 in a storage location, or from a user's belt or the like. The prying tool 56 is shown in a position for ease of use where it does not interfere with the handle 16. However, the prying tool 56 can be positioned in other locations on the body 30 within the scope of the present invention. Further, the tool 56 can comprise more than one separate piece.

Figure 9:
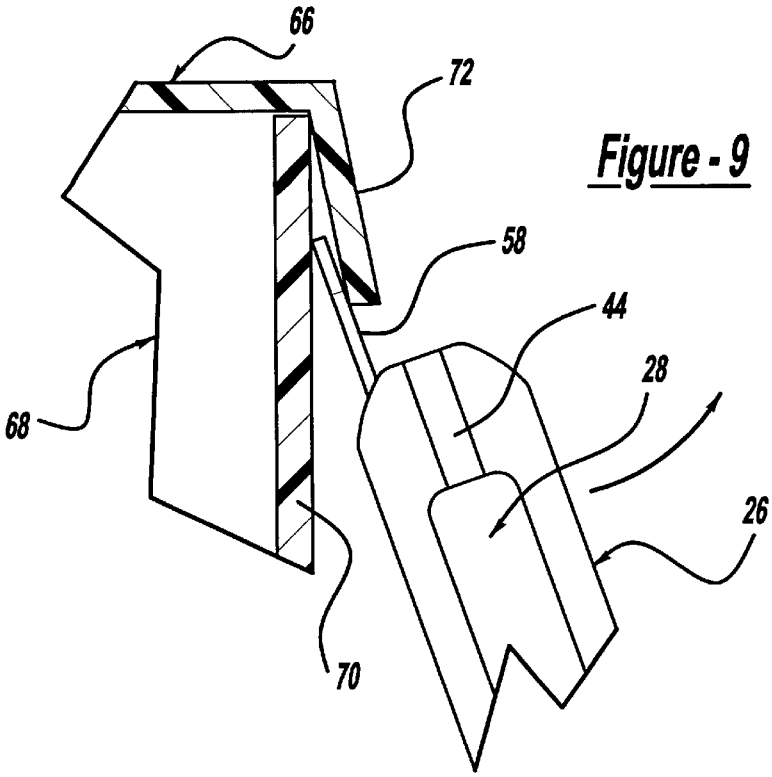
FIG. 9 is a cut-away view of the removable grip of the invention being used to pry up a rim of a bucket lid.

FIG. 9 is a cut-away view showing the grip 26 being used to pry open a lid 66 of a bucket 68. As shown, the flat end 58 is positioned between a bucket portion 70 and a rim 72 of the lid 66. The grip 26 is then rotated away from the bucket portion 70 to lift the rim 72 and remove the lid 66 from the bucket portion 70.

Figure 10:
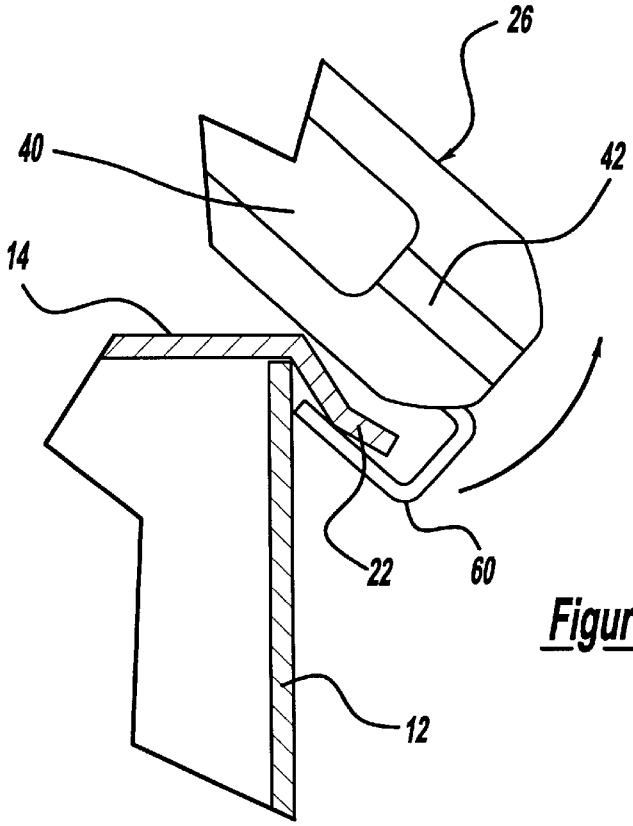
FIG. 10 is a cut-away view of the removable grip of the invention being used to pry up a tab of a plastic bucket lid.

FIG. 10 is a cut-away view showing the grip 26 being used to remove the lid 14 from the bucket 10. In this example, the hooked end 60 is positioned between the bucket portion 12 and one of the tabs 22. The grip 26 is rotated away from the bucket portion 12 to lift the tab 22. The hooked end 60 can be used to pry up as many tabs 22 as necessary to remove the lid 14 from the bucket portion 12.

Figure 11:
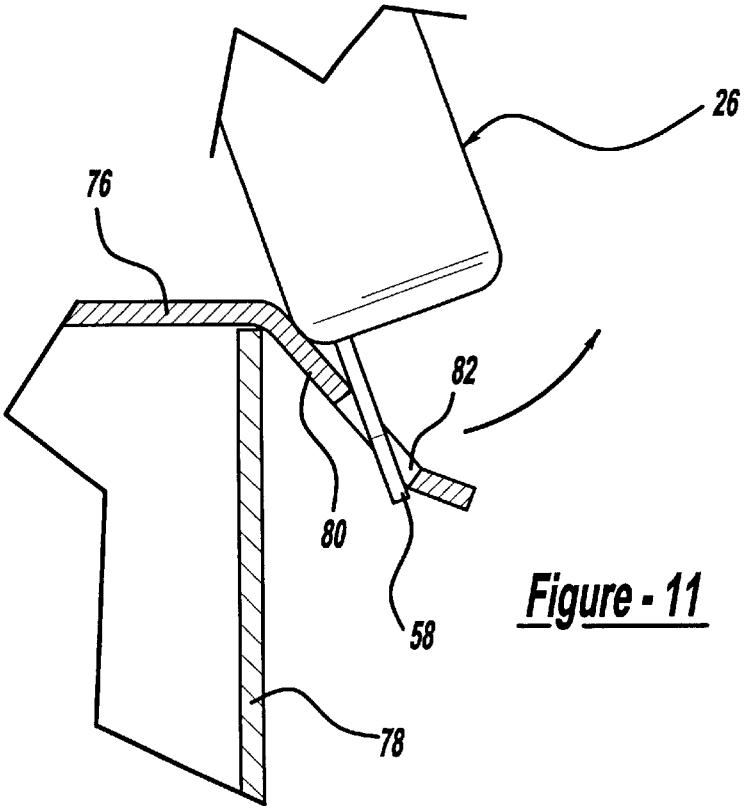
FIG. 11 is a cut-away view of the removable grip of the invention being used to pry up a tab of a metal bucket lid.

FIG. 11 is a cut-away view showing the grip 26 being used to remove a lid 76 from a metal bucket 78. The lid 76 includes a plurality of metal tabs 80 extending from the lid 76 that secure it to the bucket 78. Each of the metal tabs 80 includes a hole 82. The flat end 58 of the prying tool 56 is positioned in the hole 82, and the grip 26 is rotated to pry the tab 80 away from the bucket 78 to remove the lid 76.

Figure 12:
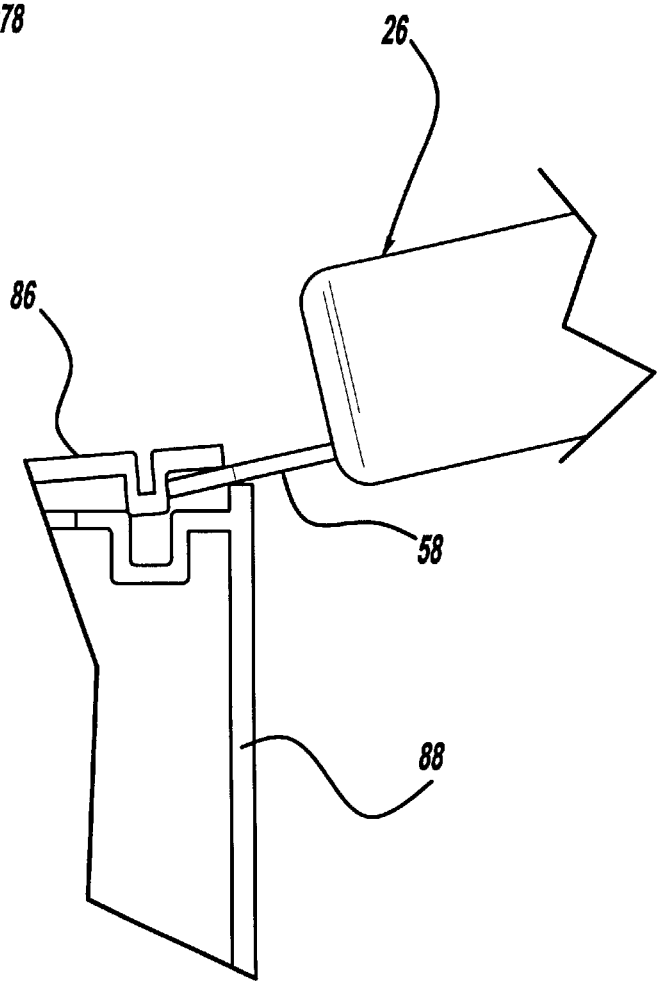
FIG. 12 is a cut-away view of the removable grip of the invention being used to pry up a lid of a paint can.

FIG. 12 is a cut-away view showing the grip 26 being used to remove a lid 86 from a paint can 88. The tab end 58 of the prying tool 56 is positioned below the edge of the lid 86 and the lid 86 is pried up.

Figure 13:
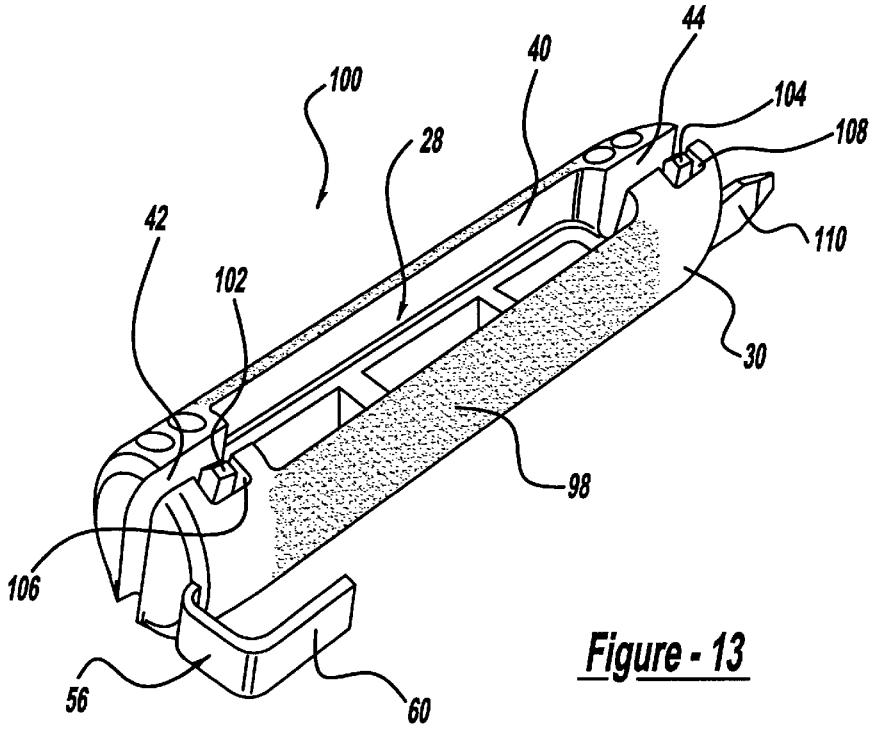
FIG. 13 is a perspective view of a removable grip for a bucket, according to another embodiment of the present invention.
Figure 14:
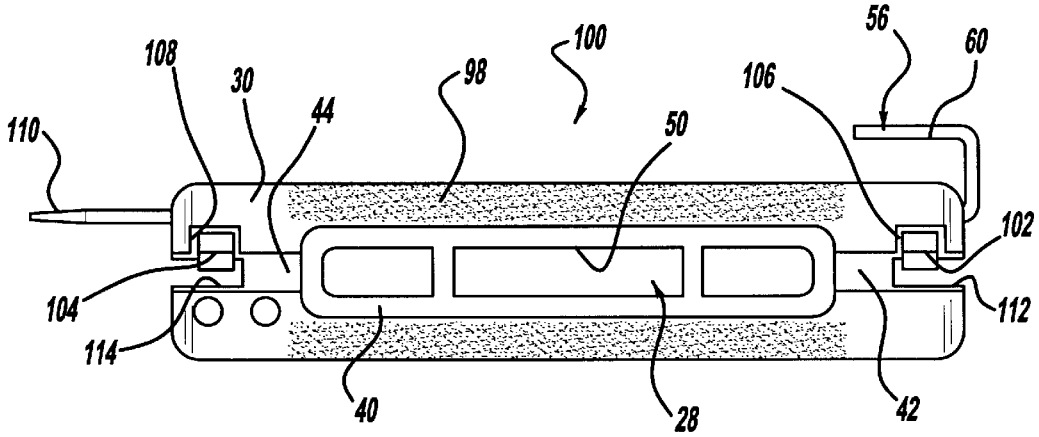
FIG. 14 is a top view of the removable grip shown in FIG. 13.

FIG. 13 is a perspective view and FIG. 14 is a top view of a removable grip 100 that is a variation of the removable grip 26 discussed above. Therefore, like elements of the grip 100 and the grip 26 are identified by the same reference numeral and operate in the same manner as discussed herein. The body 30 of the grip 100 has a roughened surface 98 that allows the user to more easily grasp the grip 100. In this embodiment, the ridges 46 and 48 on the opposing side walls of the narrow portions 42 and 44 are eliminated, but are replaced with a first flexible tab 102 formed in the narrow portion 42 and a second flexible tab 104 formed in the narrow portion 44. The tabs 102 and 104 are vertically extending elongated members secured to the body 30 at a bottom portion of the tab 102 or 104. The tab 102 is formed in a recess 106 and the tab 104 is formed in a recess 108. Further, a cut-out portion 112 is removed from the narrow portion 42 and a cut-out portion 114 is removed from the narrow portion 44 at the bottom of the body 30.

The tabs 102 and 104 are generally wedge-shaped so that an upper portion of the tabs 102 and 104 is thicker than a bottom portion of the tabs 102 and 104. Thus, the upper portion of the tabs 102 and 104 extends into the channel formed by the narrow portions 42 and 44. When the bail 24 is forced into the narrow portions 42 and 44, the tabs 102 and 104 flex into the recesses 106 and 108, respectively. Once the bail 24 goes beyond the thicker upper portions, the tabs 102 and 104 flex back, locking the bail 24 within the narrow portions 42 and 44.

In this embodiment, the flat end 58 has been replaced with a screwdriver end 110. The screwdriver end 110 is still applicable to pry the lids off of a bucket as discussed herein, but is also applicable to be used as a screwdriver to drive or remove screws. In alternate embodiments, the shape of the end 110 can have other screwdriver tips, such as hexagonal or Philips head screwdrivers, or any other suitable prying shape for other prying applications.

The foregoing discussion discloses and describes merely exemplary embodiments of the present invention. One skilled in the art will readily recognize from such discussion, and from the accompanying drawings and claims, that various changes, modifications or variations can be made therein without departing from the spirit and scope of the invention as defined in the following claims.

What is claimed is:

1. A grip that can be removable attached to a handle, said grip comprising an elongated body including a first end and a second end, said body further including an open channel extending from the first end to the second end, said open channel including a widened portion centrally disposed within the body, a first narrow portion extending from one end of the widened portion and through the first end of the body and a second narrow portion extending from an opposite end of the widened portion and through the second end of the body, said widened portion having a bottom surface that is sized and configured to accept a grip portion of the handle, said grip further comprising a prying tool formed in the elongated body, said prying tool including at least a first end extending from the first end of the body, wherein the first end of the prying tool is configured to pry a lid off a bucket.

2. The grip according to claim 1 wherein the elongated body further includes a first pair of opposing ridges formed on inner walls of the first narrow portion and a second pair of opposing ridges formed on inner walls of the second narrow portion, wherein the first and second pairs of opposing ridges are configured to accept the handle in a locking engagement.

3. The grip according to claim 1 wherein the elongated body further includes a first flexible tab formed in a recess on an inner wall of the first narrow portion and a second flexible tab formed in a recess on an inner wall of the second narrow portion, wherein the first and second tabs lock the handle in a locking engagement within the open channel.

4. The grip according to claim 1 wherein the prying tool includes a first end extending from the first end of the body and a second end extending from the second end of the body, wherein either or both of the first end and the second end of the prying tool are configured to pry a lid off a bucket.

5. The grip according to claim 4 wherein the first end of the prying tool extending from the first end of the body is a hooked end, and the second end of the prying tool extending from the second end of the body is a flat end.

6. The grip according to claim 5 wherein the second end of the prying tool is a screwdriver tip.

7. The grip according to claim 1 wherein the elongated body is a molded plastic body and the prying tool is a steel prying tool molded within the body.

8. The grip according to claim 1 wherein the first and second narrow portions slant down from the bottom surface of the widened portion and are configured in size to the handle.

9. A removable grip for a bucket, said grip comprising:

an elongated body including a first end and a second end, said body further including an open channel extending from the first end to the second end that accepts a handle of the bucket so that the bucket can be lifted by the grip when the handle is positioned within the channel, said body including at least one tab positioned within the channel where the tab flexes in response to the handle being positioned within the channel to lock the handle therein; and a prying tool formed in the elongated body, said prying tool including at least a first end extending from the first end of the body, wherein the first end of the prying tool is configured to pry a lid off of the bucket.

10. The grip according to claim 9 wherein the channel includes a widened portion centrally disposed within the body, a first narrow portion extending from one end of the widened portion and through the first end of the body, and a second narrow portion extending from an opposite end of the widened portion and through the second end of the body.

11. The grip according to claim 10 wherein the first and second narrow portions slant downwards away from the widened portion.

12. The grip according to claim 10 wherein the at least one tab is a first flexible tab positioned within a recess formed in a wall of the first narrow portion and a second flexible tab positioned within a recess formed in a wall of the second narrow portion.

13. The grip according to claim 9 wherein the elongated body is a cylindrical-shaped body.

14. The grip according to claim 9 wherein the first end of the prying tool is a planar member or a hooked prying member.

15. The grip according to claim 14 wherein the first end of the prying tool is a screwdriver tip.

16. The grip according to claim 9 wherein the prying tool includes a first end extending from the first end of the body and a second end extending from the second end of the body.

17. The grip according to claim 16 wherein the first end of the prying tool extending from the first end of the body is a hooked end, and the second end of the prying tool extending from the second end of the body is a flat end having a tapered section.

18. The grip according to claim 9 wherein the elongated body is a molded plastic body and the prying tool is a steel prying tool molded within the body.

19. A grip that can be removably attached to a handle of a bucket for carrying the bucket, said handle including a bail and a grip portion, said grip comprising:

an elongated cylindrical body including a first end and a second end, said body further including an open channel extending from the first end to the second end, said open channel including a widened portion centrally disposed within the body, a first narrow portion extending from one end of the widened portion and through the first end of the body and a second narrow portion extending from an opposite end of the widened portion and through the second end of the body, said widened portion having a bottom surface that is sized and configured to accept the grip portion of the handle, and said first and second narrow portions slanting down from the bottom surface of the widened portion and being configured and sized to accept the bail of the handle, said elongated body further including a first flexible tab positioned within a recess formed in an inner wall of the first narrow portion and a second flexible tab positioned within a recess formed in an inner wall of a second narrow portion, wherein the first and second flexible tabs are configured to accept the bale in a locking engagement; and a prying tool molded in the elongated body, said prying tool including a first end extending from the first end of the body and a second end extending from the second end of the body, said first end of the prying tool being a hooked end and said second end of the prying tool being a flat end, where either or both of the first end and second end of the prying tool are configured to pry a lid off of the bucket.

20. The grip according to claim 19 wherein the body is a molded plastic body and the prying tool molded within the body.

21. A grip that can be removably attached to a handle, said grip comprising an elongated body including a first end and a second end, said body further including an open channel extending from the first end to the second end, said open channel including a widened portion centrally disposed within the body, a first narrow portion extending from one end of the widened portion and through the first end of the body and a second narrow portion extending from an opposite end of the widened portion and through the second end of the body, said elongated body further including a first flexible tab formed in a recess on an inner wall of the first narrow portion and a second flexible tab formed in a recess on an inner wall of the second narrow portion, wherein the first and second tabs lock the handle in a locking engagement within the open channel.

22. The grip according to claim 8 further comprising a prying toll formed in the elongated body, said prying tool including at least a first end extending from the first end of the body, wherein the first end is configured to pry a lid off a bucket.

* * * * *

UNITED STATES PATENT AND TRADEMARK OFFICE

CERTIFICATE OF CORRECTION

PATENT NO. : 6,497,006 B2
DATED : December 24, 2002
INVENTOR(S) : Gallup

It is certified that error appears in the above-identified patent and that said Letters Patent is hereby corrected as shown below:

Column 6,
Line 54, insert -- is a steel prying tool -- after "tool".

Signed and Sealed this

Twentieth Day of September, 2005

JON W. DUDAS
*Director of the United States Patent and Trademark Office*